United States Patent [19]

Comollo

[11] 4,197,891

[45] Apr. 15, 1980

[54] COMBINATION BEACH MAT AND SHOULDER BAG

[75] Inventor: June Comollo, New York, N.Y.

[73] Assignee: Cerenique, Inc., New York, N.Y.

[21] Appl. No.: 27,889

[22] Filed: Apr. 6, 1979

[51] Int. Cl.[2] ..... A45C 9/00

[52] U.S. Cl. ..... 150/12; 5/417; 190/2

[58] Field of Search ..... 5/417, 418, 419, 420; 150/7, 12, 1.7; 190/2

[56] References Cited

U.S. PATENT DOCUMENTS

| | | | |
|---|---|---|---|
| 2,315,126 | 3/1943 | Michalke | 5/417 |
| 3,143,748 | 8/1964 | Manning | 05/420 |
| 3,477,552 | 11/1969 | Goldman | 190/2 |
| 3,976,113 | 8/1976 | Kim | 150/12 |
| 4,062,392 | 12/1977 | Ishii | 150/1.7 |

FOREIGN PATENT DOCUMENTS

| | | | |
|---|---|---|---|
| 819449 | 10/1951 | Fed. Rep. of Germany | 5/417 |
| 1215109 | 11/1959 | France | 150/1.7 |
| 1264919 | 2/1972 | United Kingdom | 5/417 |

*Primary Examiner*—Donald F. Norton
*Attorney, Agent, or Firm*—Barry G. Magidoff

[57] ABSTRACT

There is provided a beach mat comprising a generally rectangular sheet of a flexible material which can be folded into a bag for carrying beach clothes. The rectangular sheet has secured along an obverse face thereof a substantially continuous loop of flexible material sewn along two substantially parallel portions of its length over a substantially central portion of the sheet. A free standing loop extends from each end of the sewn down portions, one loop portion extending beyond a first end of the sheet. Flexible fastening means are secured to the reverse face of the sheet along one edge thereof and second, mating flexible fastening means are connected to the obverse face of the sheet at a location of approximately one-third the distance from the second edge towards the first edge.

5 Claims, 5 Drawing Figures

COMBINATION BEACH MAT AND SHOULDER BAG

The present invention relates to a combination carrying case and beach mat construction.

There is a wide selection in the prior art of combination beach bags and blanket constructions from which the user can choose. However, the prior constructions do not completely fulfill the needs of the individual traveling to the beach for a single day, who wishes to carry only a soft flat mat and light changes of clothing. The prior constructions have provided relatively complex or unwieldy constructions for achieving these aims, and have often been unsatisfactoy in that they are often either complex constructions which require considerable skill in manipulating and/or comprise undesirably hostile elements, such as hooks, zippers, or snaps, which can cause at least minor injury or irritation to the user in the beach mat, or sheet, made. Reference is made particularly to the following U.S. Pat. Nos: 3,477,552; 3,483,575; 2,783,473; 2,870,464; 3,818,962; 2,659,404; 2,451,142; 4,101,994; 2,344,010; and 3,143,748. Also note, Australian Pat. No. 28323/30 and French Pat. No. 485,722 and Australian No. 109,761.

In accordance with the present invention, a combination carrying case and beach mat construction is provided which is extremely simple to operate, is of a straightforward construction that will not be prone to breakdown, and provides a beach mat substantially completely free of hostile, dangerous, surfaces or edges. The present invention is based upon a seemingly simple combination of elements, which, however, act together to provide an unexpectedly secure carrying case, in a folded condition, while providing an extremely safe and comfortable flat mat in the fully extended position. The combination device can be manufactured with great ease and economy, and can be utilized by any person with a minimum of explanation, the configuration even enabling instructions to be printed on the mat and used during the folding operation.

Generally, the combination apparatus of this invention comprises a flat sheet of flexible material, including a woven or knit fabric or a continuous sheet of polymeric plastic material, such as the synthetic polyolefins or polyesters. To a first, or obverse, face of the sheet is secured a substantially continuous loop of soft, flexible material, preferably of the same material as the sheet, the loop being secured to the sheet along two straight and preferably parallel longitudinal portions. Flexible fastening means, such as attaching tape, are secured along a first longitudinal edge of the reverse face of the sheet, and along a portion of the obverse face of the sheet at a location intermediate the second longitudinal edge of the sheet and the continuous loop.

The above beach mat can be folded to form a secure carrying case by longitudinally folding the second edge over the obverse face about an axis between the second fastening means and the continuous loop of fabric; longitudinally folding the first edge over the obverse face and over the second edge such that the first fastening means mate with and fasten to the second fastening means. The longitudinally folded and fastened sheet is then folded laterally, beginning at the second end, upwardly towards the first end until the second ends of the secured parallel portions of the continuous loop are facing in the direction of the obverse face. The first end is then folded over the previous transverse folds such that the second end is adjacent the beginning of the sewn down portions; the two free loops are held together and extended beyond the folded second end.

The invention herein is exemplified by the embodiments described hereinbelow and depicted in the accompanying drawings. These preferred embodiments are presented herein to provide a more clear understanding of the invention and its advantages, and not to define the full scope thereof.

IN THE DRAWINGS

Figure 2:
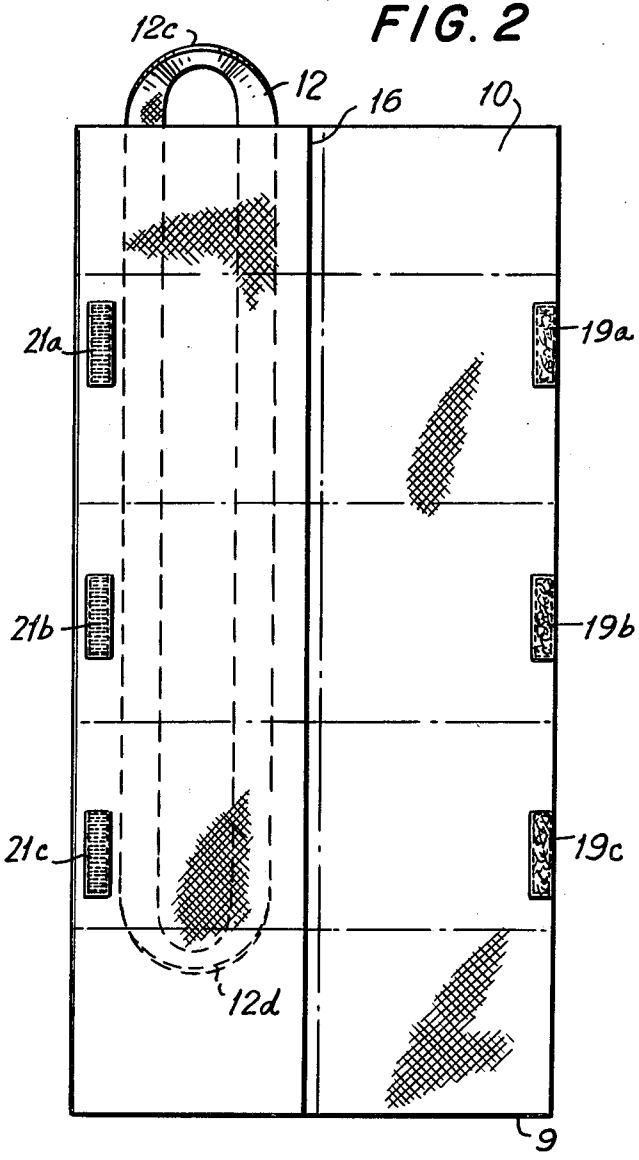
FIG. 2 is a plan view of the mat of the present invention in its first longitudinally folded position.
Figure 1:
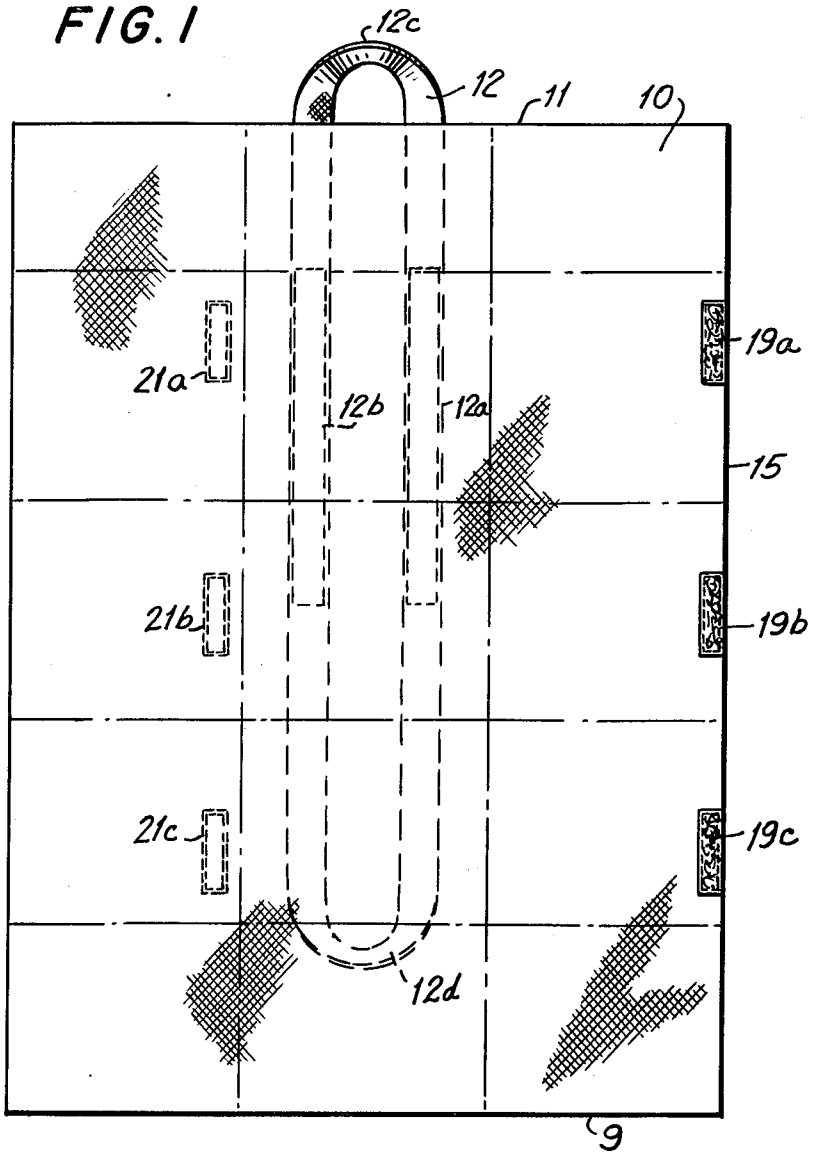
FIG. 1 is a plan view of the reverse face of the open mat in accordance with the present invention.

Referring to the drawings, a flat sheet 10, formed of a fully flexible material, such as a woven or knit fabric, e.g., a light canvas, a continuous plastic sheet, or even a soft, bonded paper-like material, such as spun-bonded polyolefin (sold as TYVEK by duPont), is provided of a suitable size to serve as a beach mat or blanket for an individual. The sheet should be sufficiently flexible so as to be foldable completely upon itself in both the lateral and longitudinal directions, under a force no greater than its own weight.

Secured to the first, or obverse, side of the sheet is a continuous loop 12 of a fully flexible material, which can be, if desired, the same material as is used to form the sheet 10, the loop is secured to the obverse face of the sheet 10 along two longitudinally extending, substantially parallel portions 12*a*, 12*b*. The loop 12 is secured to the sheet 10 by known means, such as by being sewn thereto with a thread, or being secured thereto by an adhesive. Extending from each end of the parallel sewn portions 12*a*, 12*b*, are free-standing loops 12*c*, 12*d*, which can serve as carrying handles, and closures, when the mat is in the fully folded condition of FIGS. 4, 5. The secured portions are placed substantially closer to one transverse end 11 of the sheet 10 and the free loop 12*c* preferably extends beyond that first end 11. Preferably, the two secured portions 12*a*, 12*b*, extend from a position on the obverse face of the mat 10, at least about 10%, and optimally not more than about 15%, of the full length thereof from the first end 11, to a position at least about one-third, and optimally from about 45 to about 55%, of the full length from the second end 9. The total lengths of the two secured portions 12*a*, 12*b* are both at least about 25% of the full sheet length, and are substantially centered between the two longitudinal edges 15, 16 of the mat 10. If the sheet 10 is rectangular, the secured portions 12*a*, 12*b* are also preferably parallel to the two longitudinal edges 15, 16.

First flexible attaching means 19 are secured along the first edge 15 of the reverse face of the sheet 10. Although the attaching means can be formed continuously along the edge 15, it has been found to be sufficient, and therefore preferred, to provide discontinuous attaching means 19 such as the attaching tapes 19*a*, *b*, *c* shown. The outer ends of the attaching means 19*a*, *c*, are located preferably inwardly from each end 9, 11 of the sheet 10 not more than about 25% of the total length of the sheet. In the embodiment shown, there are three separate attaching tapes 19, although a greater number of elements can be utilized. The mating attaching tapes 21 are secured to the obverse face of the sheet 10 at a location intermediate the second edge 16 and the secured portion 12*b*. As shown in FIG. 2, when the sheet 10 is folded to form the carrying case, the second attaching means 21 lies above the obverse face of the sheet 10 and thus can mate with the first attaching means 19 when the first edge 15 is folded over, as shown in FIG. 3.

The attaching means 19, 21 are shown as three discontinuous lengths of an attaching tape, which may be of the type having a plurality of hook-forming pile threads. Such an attaching tape is manufactured under the trade name "VELCRO". Each strip of tape is cemented or otherwise secured, as by sewing, to the sheet 10; the exposed surfaces of the tape are of a construction that when two tapes are brought together, they firmly join such that a substantial force is required to separate the tapes when pulling in a direction perpendicular to the surfaces, but the two tapes can be readily peeled apart. In addition to this "hook-and-eye" type of fastening tape, flexible magnetic tapes can also be utilized. Finally, a less-preferred flexible fastening means are a series of string ties which can be attached at the locations of the tape 19, 21 shown on the drawings.

Figure 3:
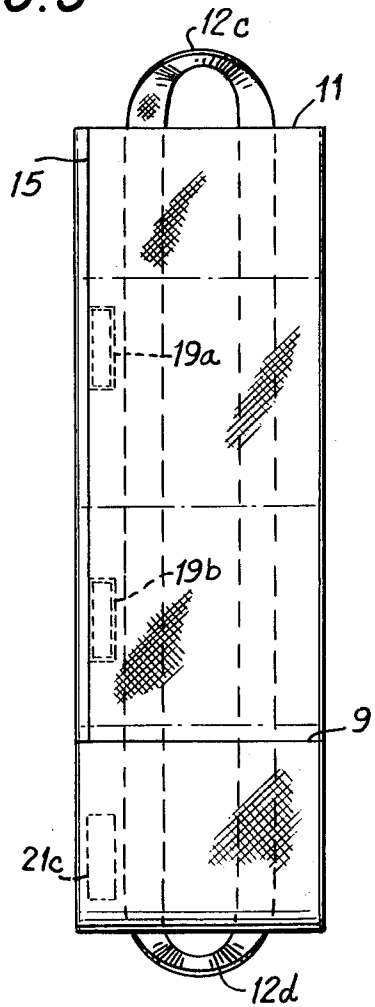
FIG. 3 is a plan view of the mat of the present invention showing a first lateral fold.

The locations of the attaching tapes should be such as to prevent the accidental opening of the folded over materials, as shown in FIG. 3, during folding, or when carrying the folded case.

Figure 5:
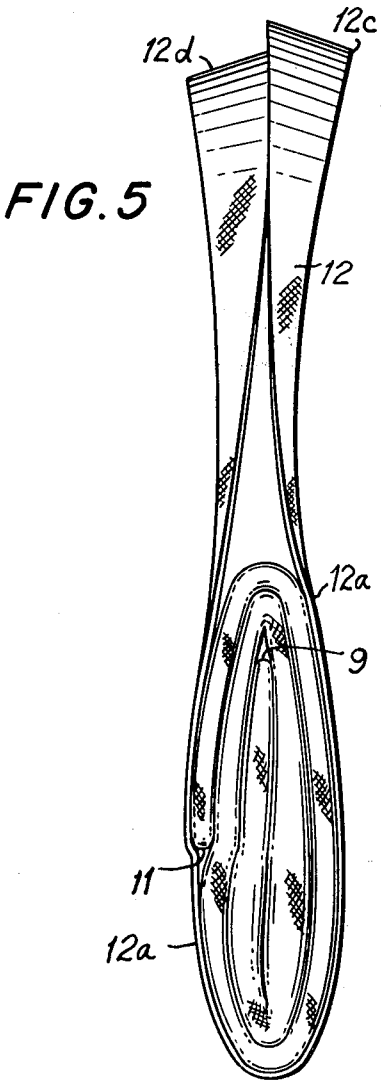
FIG. 5 is a side view of the mat in its fully closed, carrying case, mode.
Figure 4:
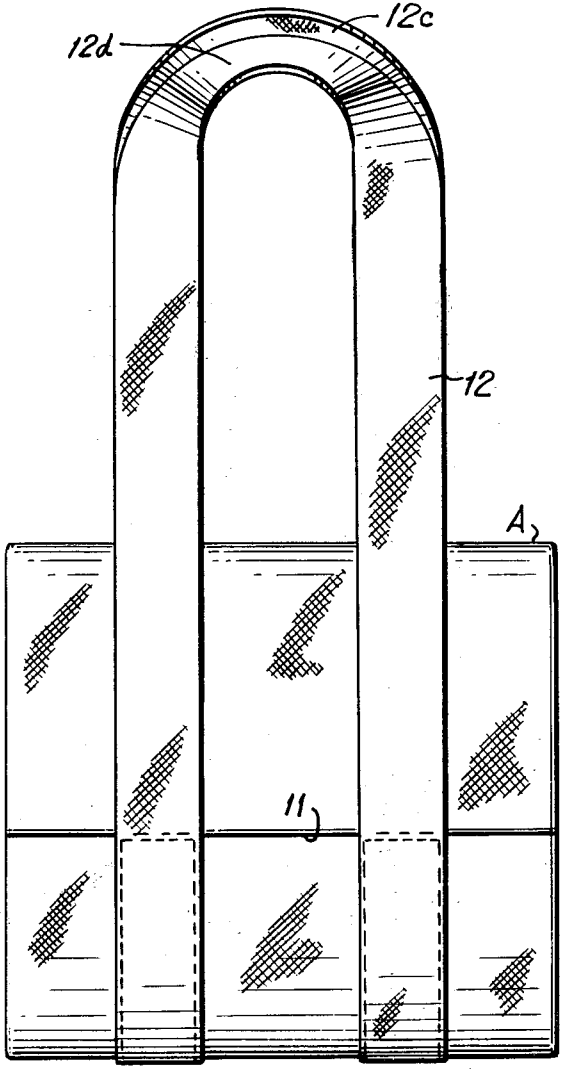
FIG. 4 is a front view of the folded mat/carrying case of the present invention shown in its fully closed, carrying case, mode.

The location of the continuous loop 12 and particularly of the portions 12*a*, 12*b*, firmly secured to the sheet 10, is also critical. The continuous loop should not be centrally secured, but rather the loop should be secured significantly closer to one end 11 than to the second end 9. As shown, the secured portions 12*a*, 12*b* are sufficiently far from the first end 11 to permit the folding over of the flap as in FIG. 4, but not so far as to permit the flap to hang too loosely. Similarly, the distance of the opposite ends of the secured portions 12*a*, 12*b* from the second end 9 should be sufficient to permit suitable folding of the sheet as shown in the drawings, and specifically to permit the folding over of the top flap without interference, as shown in FIGS. 4 and 5.

The distance between the outer edges of the secured portions 12*a*, 12*b*, is at least about 4 inches, and preferably at least about 6 inches.

The preferred method of folding the convertible mat to a beach bag, or travel bag in accordance with the present invention comprises folding the second edge 16 about a longitudinal axis preferably parallel to the secured portions 12*a*, 12*b* and separated from the second edge 16 by a distance of at least about 25% of the full width of the sheet 10, but the longitudinal axis must be intermediate the second fastening tapes 21 and the sewn down portion 12*b*. The first edge 15 is then folded over the second edge 16, also about a longitudinal axis parallel thereto, such that the fastening tapes 19 engage with and become secured to the second fastening tapes 21. The folding process is begun with the sheet resting upon the obverse face, i.e., upon the continuous loop 12.

The longitudinally folded sheet is then transversely folded such that the second end 9 is folded up and over the lower portion of the sheet 10 followed by successive such transverse folds until the lower ends of the secured portions 12*a*, 12*b* are also folded. Preferably, there are at least two, and most preferably three, such lateral folds from the second end 9, as shown in the drawings. After making the last such lower lateral fold, as shown in FIG. 4, the secured portions 12*a*, 12*b* are folded; there should be sufficient distance between the top line of the fold, indicated by the letter A in FIG. 4, and the beginning of the secured portions 12*a*, 12*b*, to permit folding over the first end 11 to form the flap shown in FIG. 5. As shown, the second loop end 12*d* is not coextensive with the first loop end 12*c*, unless the bottom of the bag is pulled slightly outwardly. This serves to further secure the bag and prevent opening when worn on or carried upon the shoulder.

The carefully designed structure of this invention makes it unnecessary to carefully fold the mat into the bag configuration. After making the two longitudinal folds, merely loosely rolling up the folded mat will result in the desired final configuration shown in FIG. 5.

The particular embodiment shown in the present drawings has the following dimensions:

Sheet Length (end 11 to end 9)—55 inches
Sheet Width (edge 15 to edge 16)—41 inches
The edges (15, 16) to secured portions 12*a*, 12*b*—16 inches
Width of the fabric forming the loop (12)—2 inches
Distance between secured portions 12*a*, 12*b*—5 inches
Circumference of the loop 12—104 inches
Length of secured portions 12*a*, 12*b*—17 inches
First end 11 to nearest secured portions 12*a*, 12*b*—8 inches (about 15% of length)
First end 11 to attachment tapes 19*a*, 21*a*—10 inches (about 20% of length)
Second end 9 to attachment tapes 19*c*, 21*c*—13 inches (about 25% of length)

The sheet and the continuous loop can be formed of any of the natural or manmade fibers, or of any of the synthetic polymers that form substantially completely flexible thin sheets. The mat can be made waterproof, by using synthetic polymer sheets and/or by applying a waterproofing agent onto any of the materials.

In addition to the simple configuration shown, patch pockets, for example, made of the same or other flexible sheet material, and with or without closure flaps, can be sewn onto one face of the flat sheet 10, for example on the reverse face.

It will be obvious to those skilled in the art that various changes can be made to the embodiment specifically described herein, both as to dimensions, materials of construction, and method of operation. The illustrated system is not intended to define the full scope of the invention, but merely to exemplify a presently preferred embodiment. The scope of the invention is defined solely by the claims set forth below.

The patentable embodiments of this invention which are claimed are:

1. A combination beach satchel and beach mat construction comprising a sheet of a flexible material having a reverse face and obverse face; a substantially continuous loop of a flexible material secured along two substantially parallel longitudinal portions to a substantially central portion of the obverse face of the sheet, a free-standing loop portion extending from either end of the secured parallel portions, one loop portion extending beyond a first end of the sheet, the secured portions extending longitudinally from a location at least about 10 percent of the distance from the first end to the second end to a location at least about 33 percent of the distance from the second end to the first end; first flexible fastening means secured to a first edge of the reverse face of the sheet and second mating flexible fastening means secured to an intermediate portion of the obverse face of the sheet, the fastening means extending longitudinally from a location distant from the first and second ends of the sheet at least about 10 percent of the full length of the sheet, the second fastening means being secured to the obverse face intermediate the second edge and the secured parallel portions, and at least about one-third the distance from the second edge to the first edge; the sheet being sufficiently flexible so as to fold completely over upon itself in both the lateral and longitudinal directions, under a force no greater than its own weight.

2. The convertible beach mat of claim 1 wherein the attaching means comprise discontinuous lengths of attaching tapes.

3. The convertible beach mat of claim 2, wherein the sheet and the continuous loop are made from a woven fabric.

4. The combination beach mat of claim 3, wherein the attachment tape comprises a plurality of hook-forming pile threads.

5. The combination beach mat of claim 4, wherein the sheet is substantially rectangular and the parallel secured portions are substantially parallel to the two edges.

* * * * *